United States Patent [19]

Gunderson

[11] Patent Number: 4,928,843

[45] Date of Patent: May 29, 1990

[54] INTEGRATED PAINT CAN AND ROLLER PAN

[76] Inventor: Roger Gunderson, 33191 Paseo Mono, San Juan Capistrano, Calif. 92675

[21] Appl. No.: 459,971

[22] Filed: Jan. 2, 1990

[51] Int. Cl.[5] ..... B65D 25/00

[52] U.S. Cl. ..... 220/90; 15/257.06

[58] Field of Search ..... 220/85 CH, 90, 212, 220/DIG. 5, DIG. 6; 222/570, 109, 111; 15/257.05, 257.06; 206/1.5

[56] References Cited

U.S. PATENT DOCUMENTS

| | | | |
|---|---|---|---|
| 471,565 | 3/1892 | Nourse | 220/85 CH |
| 476,254 | 6/1892 | Daler . | |
| 606,111 | 6/1898 | Allen . | |
| 2,698,450 | 6/1952 | Mack | 15/257.06 |
| 2,705,334 | 4/1955 | Farrow | 15/121.2 |
| 2,705,657 | 4/1955 | DiGiorgio | 220/85 CH |
| 2,827,648 | 3/1958 | Geisz | 15/121.2 |
| 2,893,030 | 10/1955 | Auerna | 15/257.06 |
| 2,988,767 | 6/1961 | Tretwold et al. | 15/257.06 |
| 3,590,416 | 7/1971 | Henningsen | 15/257 |
| 3,850,298 | 11/1974 | Jolly | 15/257.06 |
| 3,901,256 | 8/1975 | Habostad | 134/138 |
| 4,083,466 | 4/1978 | McManaway | 220/90 |
| 4,145,789 | 3/1979 | Morgan, Sr. | 15/257.06 |
| 4,561,556 | 12/1985 | Bendix | 220/90 |

*Primary Examiner*—Stephen P. Garbe
*Assistant Examiner*—Stephen Cronin
*Attorney, Agent, or Firm*—Stetina and Brunda

[57] ABSTRACT

An integral paint can/roller pan is disclosed which serves the functions of storing a volume of paint and of serving as a roller pan. The device comprises a paint can base having a peripheral channel formed about the upper surface thereof and a lid for engaging the peripheral channel to close paint within the paint can base. The lid may alternately be disposed in a configuration wherein it engages the peripheral channel and extends upwardly from the paint can base to serve as roller pan.

8 Claims, 3 Drawing Sheets

INTEGRATED PAINT CAN AND ROLLER PAN

BACKGROUND OF THE INVENTION

The present invention relates to paint cans and, more particularly a paint can that is formed to be useful as a roller pan permitting use of a roller directly into the paint can without any additional apparatus.

Painting frequently may become a time consuming, expensive and messy task, particularly for the occasional do it yourselfer who does not possess a wide assortment of painting equipment. Though various types of improvements have been made in paint quality and undercoatings the paint container itself has remained substantially the same for hundreds of years and serves little or any useful purpose other than holding the paint. Though a hand brush may be immersed into the paint can and then applied to a surface to be painted, paint is more typically emptied from the can into a storage basin more convenient for the mode of application.

When the paint is to be applied using a roller brush the paint is typically poured from the paint can into a roller pan, or a roller pan liner that is formed to receive the roller while providing a reservoir for the paint. When the painting is completed the remaining paint is poured back into the paint can after which the roller pan must be cleaned, and/or the roller pan liner discarded.

The occasional painter desiring to use a roller brush must frequently purchase the roller pan and/or roller pan liners along with the roller brush. Additionally, the task of carefully pouring paint from one container to another and of cleaning the emptied containers can be cumbersome and result in paint spillage in the surrounding area.

The present invention is directed to a novel paint can wherein the constituent portions of the paint can, i.e. the lid and base, are formed to cooperate to permit the paint can to serve as a roller pan, while still performing the functions of a traditional paint can. The invention is intended to eliminate the need to purchase a separate roller pan or roller pan insert along with the paint. Thus, the invention helps the professional or weekend painter by minimizing the tools necessary in order to perform the painting.

SUMMARY OF THE INVENTION

An integral paint can/roller pan is disclosed which serves the functions of storing a volume of paint and of serving as a roller pan. The device comprises a paint can base having a peripheral channel formed about the upper surface thereof and a lid for engaging the peripheral channel to close paint within the paint can base. The lid may alternately be disposed in a configuration wherein it engages the peripheral channel and extends upwardly from the paint can base to serve as roller pan. A variety of different arrangements are contemplated for securing the paint can lid to the paint can base when the lid serves as a roller pan. In one configuration the paint can lid slidably engages apertures formed in the peripheral channel about the upper surface of the paint can base.

In another embodiment the paint can lid is formed to have a plurality of rotatable support arms which engage the paint can base, e.g. along the peripheral channel, to support the lid when it is utilized as a roller pan.

The underside of the paint can lid is preferably ribbed to facilitate even distribution of paint along a roller brush.

The inner surface of the paint can is preferably formed in an arcuate shape to receive the roller brush and to facilitate contact between roller brush and paint within the paint can.

DETAILED DESCRIPTION OF THE PREFERRED EMBODIMENT

The detailed description set forth below in connection with the appended drawings is intended as a description of the presently preferred embodiment of the invention, and is not intended to represent the only form in which the present invention may be constructed or utilized. The description sets forth the functions and sequence of steps of constructing and operating the invention in connection with the illustrated embodiments. It is understood, however, that the same or equivalent functions and sequences may be accomplished by different embodiments that are also intended to be encompassed Within the spirit and scope of the invention.

Figure 1:
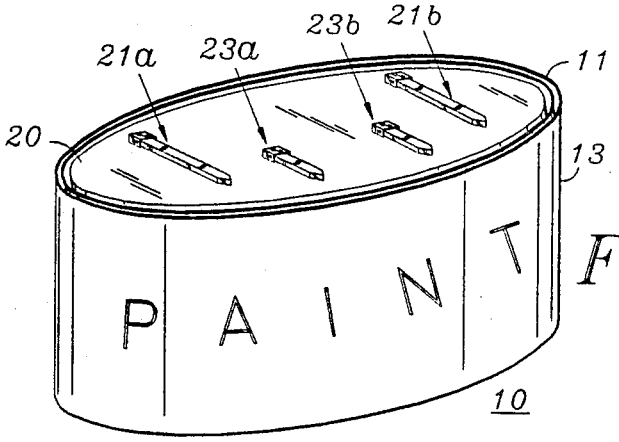
FIG. 1 is a front perspective view of an integral paint can and roller pan formed in accordance with the present invention.

FIG. 1 is a perspective view of an integral paint can/-roller pan formed in accordance with the present invention. The paint can/roller pan 10 incorporates a base 13 and lid 11. The lid 11 includes lid body 20. Pivotal support arms 21*a*, 21*b*, 23*a* and 23*b* are formed on the upper surface of lid body 20.

Figure 2:
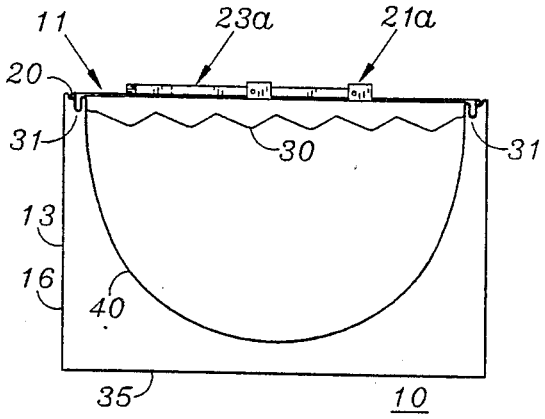
FIG. 2 is a side view of the device illustrated at FIG. 1.

FIG. 2 illustrates a side view of the integral paint can/roller pan 10. As shown therein the base 13 includes outer surface 16 and inner surface 40. The inner surface 40 is preferably formed in an arcuate shape to facilitate storage of the paint within the paint can while making it accessible to the roller brush. The base 13 may also include a bottom surface 35. However, it is anticipated that the bottom surface 35 could be eliminated for ease of manufacturing.

As further shoWn in FIG. 2 lid 11 preferably has a ribbed under surface 30. As described in more detail below the ribbed under surface 30 serves a function similar to the ribbed inclined surface of a traditional roller pan.

Figure 3A:
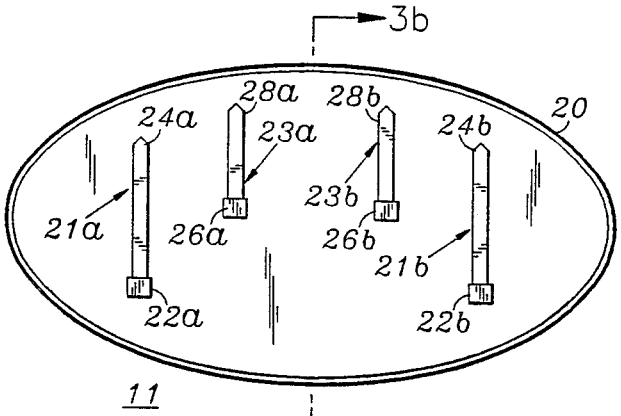
FIG. 3*a* is a top view of the paint can lid.

FIG. 3*a* is a top view of the lid 11, illustrating in more detail the pivotal support arms formed thereon. Support arm 21*a* includes a pivot housing 22*a* rigidly secured to the lid body 20, and an arm 24*a* pivotally connected to the housing 22a. The pivot support arms 21b, 23a and 24b are similarly constructed to include pivot housings 22b, 26a and 26b respectively, and arms 24b, 28a and 28b pivotally connected thereto.

Figure 3B:
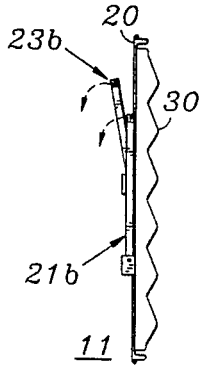
FIG. 3*b* is a side view of the lid shown at FIG. 3*a;*

FIG. 3b is a side view of the lid 11 shown at FIG. 3a. As shown therein the lid is formed such that the support arms pivot away from the lid body 20 to permit engagement with the base 13, as described more fully below.

Figure 4A:
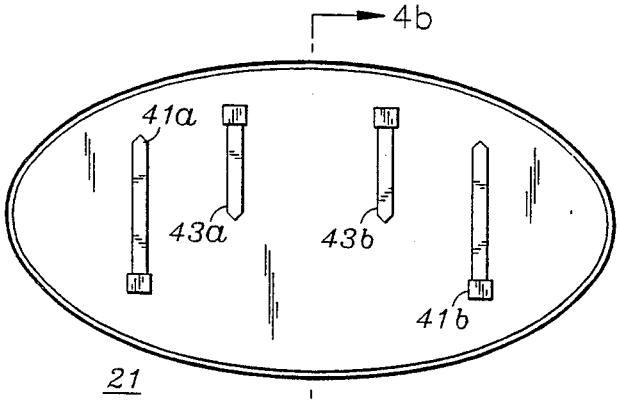
FIG. 4*a* is a top view of an alternate paint can lid.
Figure 4B:
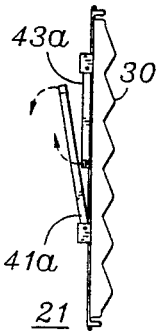
FIG. 4*b* is a side view of the lid shown in FIG. 4*a;*

FIG. 4a and FIG. 4b illustrate an alternate construction of lid 11 wherein the support arms 41a, 41b, 43a and 43b are in an alternate relative configuration. As shown at FIG. 4b the support arms 41a and 43a open in opposing directions. However, in their broader aspect the cooperation of the lid and base 13 is the same as illustrated in connection with the embodiment illustrated at FIG. 3a.

Figure 5:
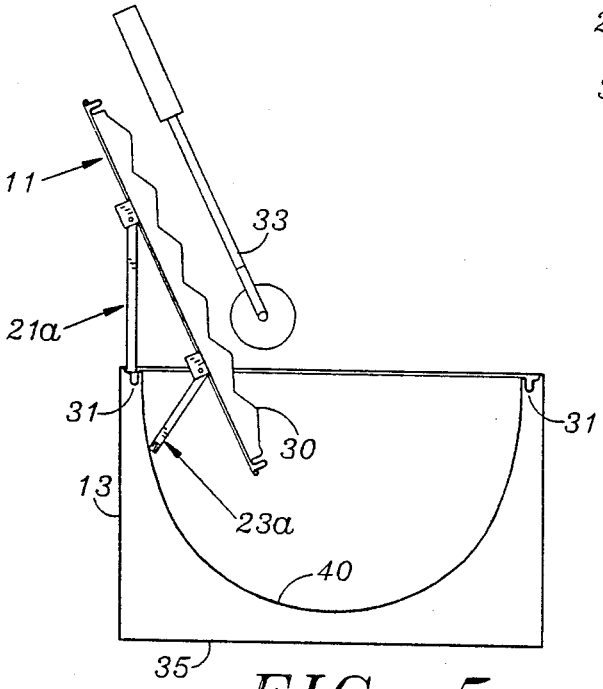
FIG. 5 is a side view of the integral paint can and roller pan in the open position.
Figure 6:
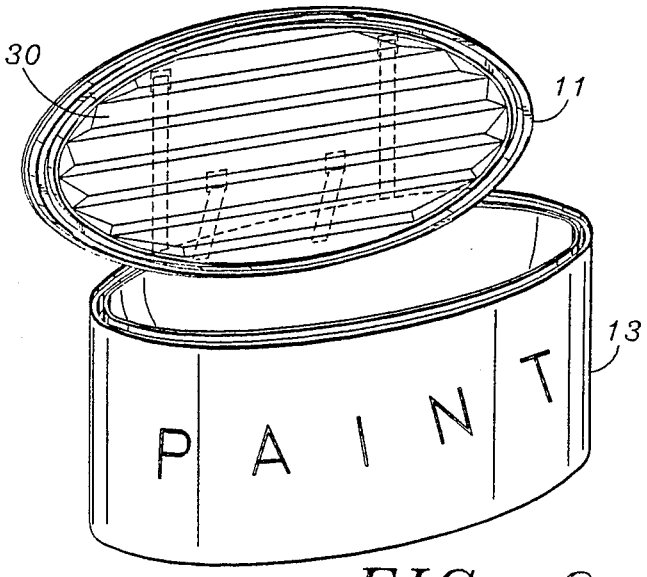
FIG. 6 is a front perspective view of the paint can and roller pan shown at FIG. 5.

FIG. 5 is a side view of the integral paint can and roller pan in an open position. FIG. 6 is a front perspective view of the integral paint can/roller pan shown at FIG. 5. As shown therein the lid 11 is connected to the base 13 with the ribbed surface 30 facing upwards and the support arms downwardly rotated to secure and support the lid 11 with respect to the base 13. The lid 11 may be provided with a peripheral channel 31 to facilitate the direction of any paint sliding along the end surfaces of rib 11 towards the paint reservoir within base 13.

The construction shown at FIG. 5 illustrates the support arms 21a and 21b secured against the base 13. More particularly, the support arm 21a abuts against and is secured to the channel 31 formed about the upper edge portion of base 13. The support arm 23a is secured against the side wall of arcuate surface 40. As a consequence of the extension of support arms 21a and 23a (as well as 21b and 23b not shown), the lid 11 is engaged to the base 13 in a manner to provide an inclined surface that may support a roller, such as roller 33. The rib surface 30 formed on lid 11 serves to facilitate application of the paint along the roller 33, as with a conventional roller pan.

Figure 7:
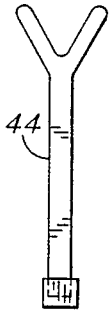
FIG. 7 illustrates an alternate lid support arm for use on the paint can lid.

FIG. 7 illustrates an alternate construction of the pivotal support arms, e.g. 21a. As shown therein the support arm 44 incorporates a "Y" shaped upper portion to facilitate abutting engagement with the base 13.

Various modifications and alternate constructions may be incorporated within the scope of the present invention. The particular structure and arrangement of the support arms, as well as the manner in which the lid engages the base may be modified within the broader aspects of the present invention. Additionally, the shape of the base 13 may similarly be modified, in a manner that may add or detract from certain of the advantages of the present invention, though still utilizing the broader contributions of an integral paint can/roller pan as provided in the present invention.

Figure 8:
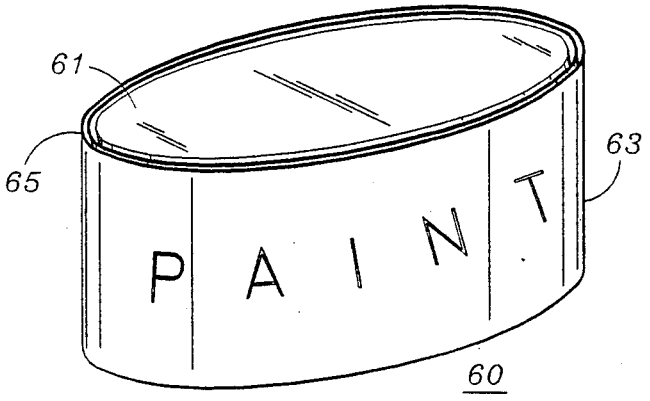
FIG. 8 is a front perspective view of an alternate embodiment of the invention.
Figure 9:
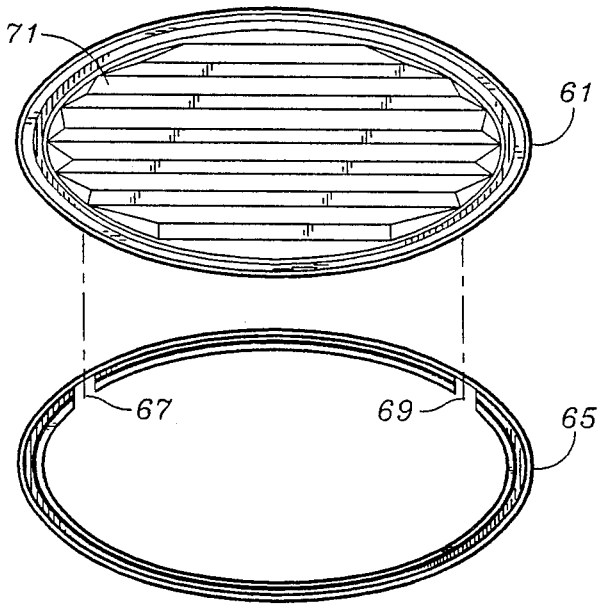
FIG. 9 is a front view of the lid and upper paint can rim shown at FIG. 8.

FIG. 8 is a front perspective view of an alternate embodiment of the present invention. As compared with the view shown at FIG. 1 it should be noted that the paint can lid 61 does not include the support arms 21a, 21b, 23a, 23b. Instead, as shown at FIG. 9, the lid 61 may be inserted in apertures 67, 69 formed in rim 65 of the paint can 63 Thus, the lid 61 may be maintained in place against the paint can 63 without the need for any support arms. As with the embodiment shown at FIGS. 1–6, the underside 71 of lid 61 is formed to include a plurality of ribs for evenly distributing the paint along a roller brush.

It should be understood that the embodiment disclosed in connection with FIGS. 8 and 9 may be implemented in various configurations, utilizing different shaped slots or appendages formed in the lid 61 to facilitate engagement with the rim 65. As previously indicated the shape of the paint can base may further be modified without departing from the broader aspects of the invention.

What is claimed is:

1. An integral paint can/roller pan which serves the functions of storing a volume of paint in a first configuration and serving as a roller pan in a second configuration, comprising:

a paint can base;

a peripheral channel about the upper surface of said paint can base; and a lid, said lid having a first and second surface;

wherein said lid may be configured in the first configuration wherein said lid is secured against and seals paint within the paint can base, and a second configuration wherein said lid is engagable to said peripheral channel such that said lid extends upwardly from said paint can base to receive a roller brush.

2. The device as recited in claim 1 wherein said peripheral channel is formed to have a plurality of notches for receiving said lid when said lid is disposed in said second configuration.

3. The device as recited in claim 1 wherein said lid comprises a plurality of pivotal support arms rotatably secured to said lid first surface, at least one of said pivotal support arms being rotatable to engage said peripheral channel to support said lid when said lid is in said second position.

4. The device as recited in claim 1 wherein said paint can base has an arcuate inner surface.

5. The device as recited in claim 4 wherein at least one of said pivotal support arms is formed to abut against said arcuate inner surface when said lid is configured in said second configuration.

6. The device as recited in claim 1 wherein said lid second surface is ribbed.

7. An integral paint can/roller pan which serves the functions of storing a volume of paint in a first configuration and serving as a roller pan in a second configuration, comprising;

a base, said base having an arcuate bottom surface, side walls and a peripheral channel extending about the upper surface of said base, said peripheral channel having a pair of apertures extending therethrough;

a lid for sealing the paint can and serving as a sloped surface for receiving a roller brush, said lid being formed to engage and seal said peripheral channel, said lid further being formed to be extendable in part within said peripheral channel apertures and remain supported therein.

8. The integral paint can/roller pan as recited in claim 7 wherein the lid is formed to have a rib surface for receiving a roller brush.

* * * * *

UNITED STATES PATENT AND TRADEMARK OFFICE

CERTIFICATE OF CORRECTION

PATENT NO. : 4,928,843

DATED : May 29, 1990

INVENTOR(S) : Roger Gunderson

It is certified that error appears in the above—identified patent and that said Letters Patent is hereby corrected as shown below:

Column 2, line 44, change "Within" to --within--.

Column 2, line 60, change "shoWn" to --shown--.

Column 3, line 14, change "lid and" to --lid 11 and--.

Column 3, line 32, change "13" to --13--.

Column 3, line 62, change "63" to --63.--.

Column 4, line 62, change "rib" to --ribbed--.

Signed and Sealed this

Thirtieth Day of July, 1991

*Attest:*

*Attesting Officer*

HARRY F. MANBECK, JR.

*Commissioner of Patents and Trademarks*